US005831192A

United States Patent [19]

Watari et al.

[11] Patent Number: 5,831,192

[45] Date of Patent: Nov. 3, 1998

[54] ELECTRONIC MUSICAL SYSTEM CONTROLLING CHAIN OF PLURAL SOUND SOURCES HAVING DIFFERING QUALITY

[75] Inventors: Koichiro Watari; Yoichiro Ogai, both of Hamamatsu, Japan

[73] Assignee: Yamaha Corporation, Hamamatsu, Japan

[21] Appl. No.: 788,166

[22] Filed: Jan. 24, 1997

[30] Foreign Application Priority Data

Jan. 26, 1996 [JP] Japan ..... 8-031198

[51] Int. Cl.[6] ..... G10H 7/00

[52] U.S. Cl. ..... 84/600; 84/645

[58] Field of Search ..... 84/600, 609, 615, 84/622, 634, 649, 653, 659

[56] References Cited

U.S. PATENT DOCUMENTS

| | | | |
|---|---|---|---|
| 5,119,710 | 6/1992 | Tsurumi et al. . | |
| 5,354,948 | 10/1994 | Toda . | |
| 5,554,814 | 9/1996 | Nakata . | |
| 5,563,359 | 10/1996 | Okamura | 84/600 |
| 5,569,869 | 10/1996 | Sone | 84/609 |
| 5,604,324 | 2/1997 | Kubota et al. | 84/622 |
| 5,616,879 | 4/1997 | Yamauchi et al. | 84/615 |
| 5,637,822 | 6/1997 | Utsumi et al. | 84/645 |
| 5,652,400 | 7/1997 | Fujimori et al. | 84/600 |
| 5,656,790 | 8/1997 | Adachi | 84/601 |

FOREIGN PATENT DOCUMENTS

| | | |
|---|---|---|
| 0 484 043 | 5/1992 | European Pat. Off. . |
| 0 597 381 | 5/1994 | European Pat. Off. . |
| 56-3587 | 1/1981 | Japan . |
| 59-30594 | 2/1984 | Japan . |
| 59-72491 | 4/1984 | Japan . |
| 59-139093 | 8/1984 | Japan . |

*Primary Examiner*—David S. Martin
*Assistant Examiner*—Jeffrey W. Donels
*Attorney, Agent, or Firm*—Graham & James LLP

[57] ABSTRACT

In a musical system, a transmitting device transmits performance data, a first receiving device is connectable to the transmitting device to receive and pass the performance data, and a second receiving device is connectable subsequently to the first receiving device to receive therefrom the performance data. The transmitting device operates to transmit first performance data arranged to drive a first sound source to generate musical tones and to transmit second performance data arranged to drive a second sound source of a type different than the first sound source. The first receiving device operates if the same has the first sound source for admitting the first performance data so as to drive the first sound source and for issuing a control message to the second receiving device. The second receiving device having the second sound source operates in response to the control message to prohibit admission of the second performance data to thereby disable the second sound source.

27 Claims, 6 Drawing Sheets

ELECTRONIC MUSICAL SYSTEM CONTROLLING CHAIN OF PLURAL SOUND SOURCES HAVING DIFFERING QUALITY

BACKGROUND OF THE INVENTION

The present invention relates to a sound source apparatus connected to a host device that transmits performance data such as automatic play data.

Conventional sound source apparatuses include a general-purpose PCM sound source and a general-purpose FM sound source, that can produce various kinds of musical tones. Recently, a specialized sound source has been proposed that can generate musical sounds higher in quality than those generated by the conventional sound source apparatuses.

However, this high-quality specialized sound source apparatus is limited to vocalizing of particular tones and therefore cannot vocalize a variety of tones. It would be practical therefore to connect both the specialized sound source and the conventional general-purpose sound source that can vocalize a variety of tones to a host apparatus such as an automatic playing apparatus via MIDI for realizing high-quality automatic playing. In this case, in order to efficiently utilize the specialized sound source, it is preferable that the automatic playing apparatus should supply MIDI play data containing control data prepared for the specialized sound source as much as possible to each sound source.

In such a constitution, the MIDI play data are supplied to the general-purpose sound source when the specialized sound source is not actually connected. However, the general-purpose sound source cannot control musical tone by use of the control data prepared for the specialized sound source, thereby making it impossible to provide musical sound of a desired tone.

For solving this problem, the general-purpose sound source may also require control data for finely controlling an envelope of the tone and filter coefficient data such that musical sounds approximating those generated by the specialized sound source can be produced.

However, when the specialized sound source is actually connected and if MIDI play data containing such envelope control data and filter coefficient data are supplied to the specialized sound source, the specialized sound source is adversely affected by the control data prepared for controlling the general-purpose sound source, resulting in generation of an overemphasized musical sound from the specialized sound source.

To solve this problem, two types of MIDI play data, one for the specialized sound source and another for the general-purpose sound source data, are prepared and supplied from the automatic playing apparatus to the specialized sound source and the general-purpose sound source, respectively. In this case, the one MIDI play data prepared for the specialized sound source are received by the specialized sound source, which generates a high-quality musical sound based on the received data. The other MIDI data prepared for the general-purpose sound source are received by the general-purpose sound source, which generates an ordinary musical sound based on the received data.

However, the general-purpose sound source is already owned by a user and therefore cannot be altered in configuration and performance thereof. It is possible for the specialized sound source to ignore the MIDI play data prepared for the general-purpose sound source since the this MIDI play data is designed to generate tones by the general-purpose sound source. However, it is impossible for the general-purpose sound source to ignore the MIDI play data prepared for specialized sound source data although this MIDI play data is designed to generate tones by the special-purpose sound source. Consequently, the MIDI play data prepared for the specialized sound source are vocalized by both of the specialized sound source and the general-purpose sound source at the same time.

To solve this problem, it is necessary for the user to reset MIDI channels such that the general-purpose sound source receives only the MIDI play data prepared therefor and does not receive the MIDI play data prepared for the specialized sound source. However, the MIDI channel resetting requires that the user be versed in the MIDI and the sound source mechanisms. Even if the user has full knowledge about these mechanisms, the setting operation is complicated. Simple connection of a newly obtained specialized sound source to the automatic playing apparatus along with the existing general-purpose sound source does not result in desired performance.

SUMMARY OF THE INVENTION

It is therefore an object of the present invention to provide a musical system configured for a specialized sound source that can realize desired performance while simplifying connection of the newly obtained specialized sound source to a host apparatus such as an automatic playing apparatus along with an existing general-purpose sound source.

In carrying out the invention and according to one aspect thereof, there is provided a musical system comprising a transmitting device that transmits performance data, a first receiving device that is connectable to the transmitting device to receive and pass the performance data, and a second receiving device that is connectable subsequently to the first receiving device to receive therefrom the performance data. The transmitting device operates to transmit first performance data arranged to drive a first sound source to generate musical tones and to transmit second performance data arranged to drive a second sound source of a type different than the first sound source. The first receiving device operates if the first receiving device has the first sound source for admitting the first performance data so as to drive the first sound source and for issuing a control message to the second receiving device. The second receiving device having the second sound source operates in response to the control message to prohibit admission of the second performance data to thereby disable the second sound source.

This novel constitution allows the first sound source such as a specialized sound source to vocalize the allotted first performance data. At the same time, the novel construction can prevent the succeedingly-connected second sound source such as a general-purpose sound source from capturing either of the first and second performance data.

In carrying out the invention and according to another aspect thereof, there is provided a musical system comprising a transmitting device that transmits performance data, a first receiving device that is connectable to the transmitting device to receive and pass the performance data, and a second receiving device that is connectable subsequently to the first receiving device to receive there from the performance data. The transmitting device operates to transmit first performance data arranged to drive a first sound source to generate musical tones, further operates to transmit second performance data having a version different than that of the first performance data and being arranged to drive a second sound source of a type different than that of the first sound source, and operates to transmit reference information which indicates correspondence between the type of the sound source and the version of the performance data. The first receiving device operates if said receiving device has the first sound source for admitting the corresponding first performance data according to the reference information so as to drive the first sound source and for issuing a control message to the second receiving device. The second receiving device having the second sound source operates in response to the control message to prohibit admission of the second performance data to thereby disable the second sound source.

This novel constitution allows the first sound source to capture necessary first performance data corresponding to the type of the first sound source for vocalization based on the reference information indicating the relationship between the versions of plural pieces of the performance data and the types of the above-mentioned sound sources. The reference information or relational data is fed from the data transmitting device. Further, the novel system can prevent the succeedingly-connected second sound source of lower priority from capturing the performance data or play data.

DETAILED DESCRIPTION OF THE INVENTION

Figure 1:
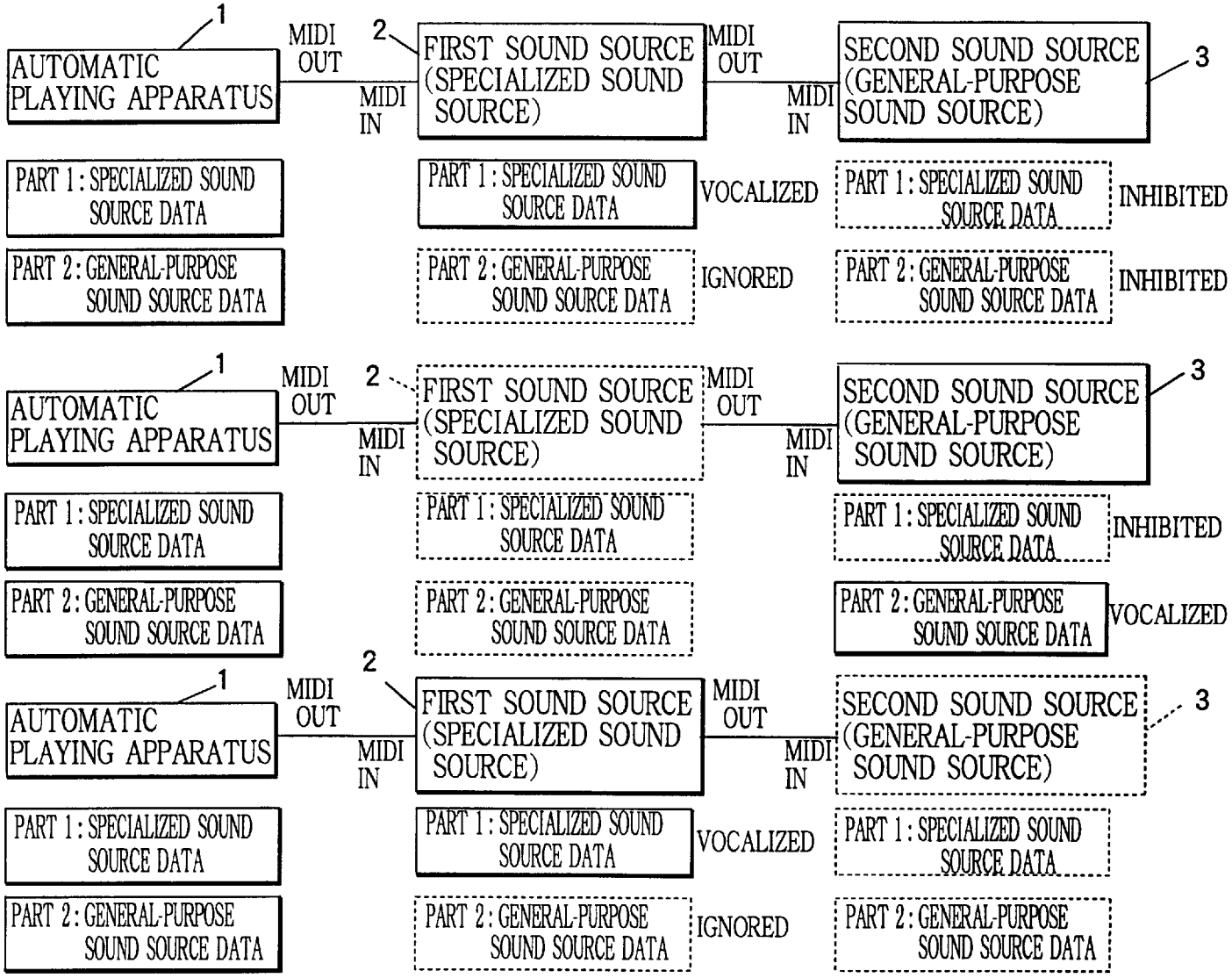
FIGS. 1(*a*)–1(*c*) are a diagram illustrating a constitution of a musical system according to the present invention, including an automatic playing apparatus along with an existing general-purpose sound source and an optional specialized sound source.

FIG. 1(*a*) shows a constitution of the inventive musical system including a specialized sound source connected to an automatic playing apparatus along with a general-purpose sound source. As shown, a MIDI cable is connected between a MIDI OUT terminal of an automatic playing apparatus 1 and a MIDI IN terminal of a first sound source 2, which is a specialized sound source of a superior type generating musical tones of high quality and being installed in a first receiving device (not shown) such as a game machine, a keyboard instrument, a personal computer, a karaoke machine and a sequencer. Another MIDI cable extends from a MIDI OUT terminal of the first sound source 2 to a MIDI IN terminal of a second sound source 3, which is a general-purpose sound source of an inferior type generating musical tones of low quality and which is equipped in a second receiving device (not shown) such as a keyboard instrument, a sequencer, a game machine, a karaoke machine and a personal computer.

If the first sound source is a high-quality sound source apparatus such as a VA sound source that generates musical sound by simulating physical behaviors of acoustic musical instruments, the first sound source can generate high-quality musical sounds that simulate a wind instrument or a stringed instrument. The second sound source is a PCM sound source or an FM sound source that can vocalize a variety of tones satisfying the GM (General MIDI) standard.

The automatic playing apparatus 1 is a transmitting device that transmits performance data to the first and second receiving devices. The transmitting device may function as a sequencer, a karaoke machine, an electronic musical instrument and a personal computer. The transmitting device allocates specialized sound source data including first performance data prepared for the first sound source to Part 1, and allocates general-purpose sound source data including second performance data prepared for the second sound source to Part 2. The automatic playing apparatus 1 sends out these parts of data concurrently. In Part 1 and Part 2, performance data of a melody line for example are sent out. Before this data sending or transmission, a part off message (Part OFF msg.) shown in FIG. 4(*a*) is transmitted. This part off message includes, in a data area, a number code of a part to be turned off. In this case, the part number to be turned off is Part 1 allocated to the specialized sound source. This part off message is effective to turn off vocalization of Part 1 in the first sound source 2 and the second sound source 3.

Figure 4:
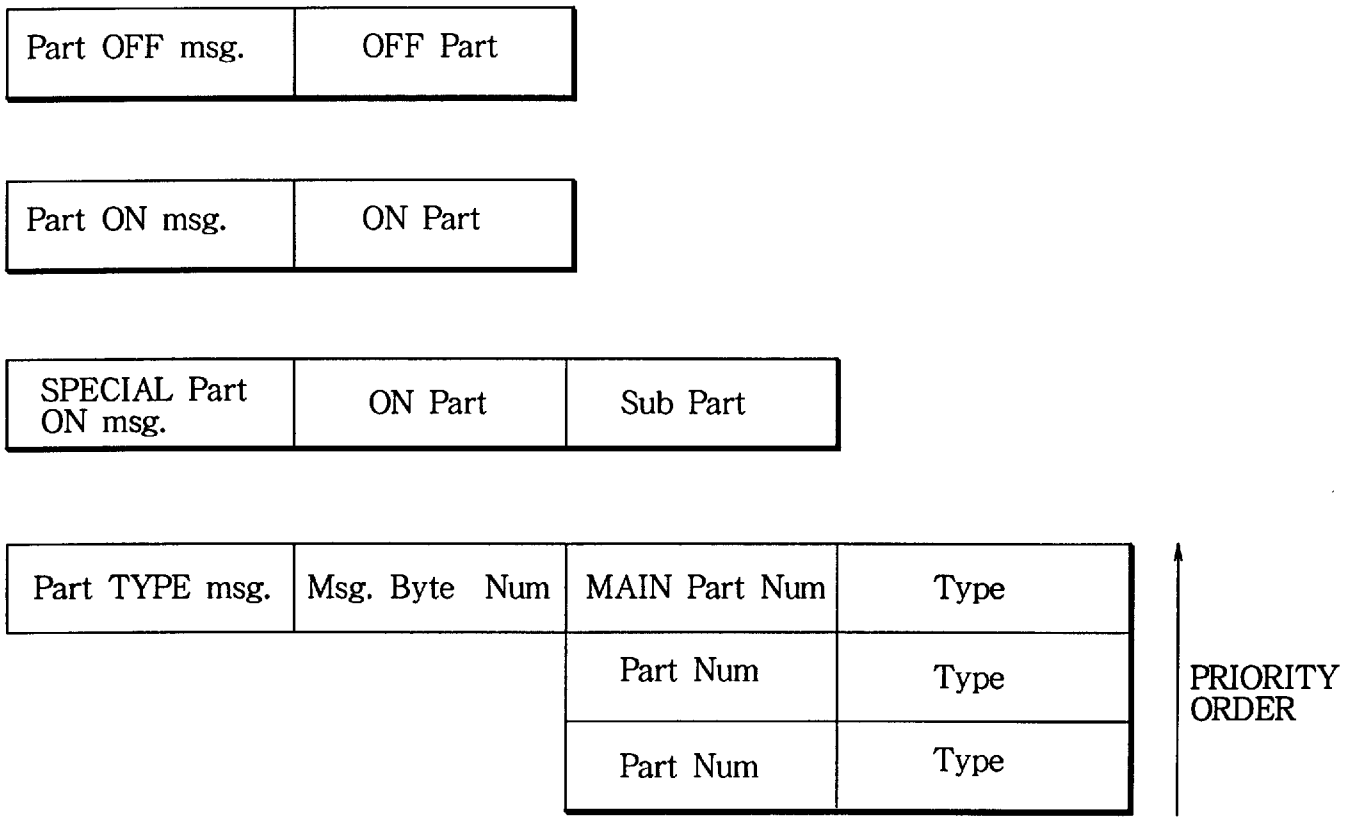
FIGS. 4(*a*)–4(*d*) are a diagram illustrating formats of various MIDI messages.

Then, the automatic playing apparatus 1 sends a special part on message (special Part ON msg.) having a format shown in FIG. 4(*c*) attached with a code that allows only the specialized sound source 2 to receive this initiative message. This special part on message includes part number information of Part 1 allocated to the specialized sound source data and number information of a sub-part designated for proxy or substitute vocalization. When this special part on message is received by the first sound source 2, vocalization of the specified Part 1 is permitted while the vocalization of the sub-part is prohibited. Further, a part off message that inhibits sub-part vocalization is issued to the succeedingly connected sound source 3. This control message inactivates the second sound source 3. In this case, the sub-part number is Part 2. Therefore, in the second sound source 3, vocalization of Part 1 and Part 2 is inhibited.

Thus, if the first sound source 2 and the second sound source 3 are actually connected to the automatic playing apparatus 1 as shown in FIG. 1(*a*), when the automatic playing apparatus 1 sends both of the specialized sound source data prepared for the sound source 2 and allotted to Part 1 and the general-purpose sound source data prepared for the sound source 3 and allotted to Part 2, the first sound source 2 of the specialized type captures or admits the specialized sound source data of Part 1 to vocalize the contained first performance data from the sound source 2. At this moment, vocalization by the general-purpose sound source data of Part 2 is inhibited because the sub-part vocalization is turned off in the first sound source 2. Moreover, since the second sound source 3 receives the part off messages of Part 1 and Part 2 from the automatic playing apparatus and the first sound source 2 as described above, vocalization of Part 1 and Part 2 according to the specialized sound source data and the general-purpose sound source data is inhibited in the second sound source 3. Consequently, a musical sound is vocalized only from the first sound source 2 with high quality.

If the automatic playing apparatus 1 is directly connected to the second sound source 3 without the intermediate first sound source 2 as shown in FIG. 1(*b*), the automatic playing apparatus 1 initially sends the part off message for turning off Part 1 before sending the specialized sound source data and the general-purpose sound source data, thereby turning off vocalization of Part 1 by the sound source 2. Then, the special part on message for turning on Part 1 is transmitted from the automatic playing apparatus. This initiative message addressed to the sound source 2 is ignored because the second sound source 3 cannot receive or process initiative message. This inhibits the vocalization of the specialized sound source data by the second sound source 3. The specialized sound source data is sent as Part 1 from the automatic playing apparatus 1, and concurrently the general-purpose sound source data is sent as Part 2 from the automatic playing apparatus 1. However, the vocalization of Part 1 is turned off in the second sound source 3 while the vocalization of the general-purpose sound source data of Part 2 is permitted in the second sound source 3.

If the automatic playing apparatus 1 is not connected to the second sound source 3, but is connected to the first sound source 2 alone as shown in FIG. 1(*c*), the automatic playing apparatus 1 initially sends out the part off message for turning off Part 1 before sending the specialized sound source data and the general-purpose sound source data, thereby once turning off the vocalization of Part 1 by the first sound source 2. Then, the special part on message is issued from the automatic playing apparatus 1 to permit the vocalization of Part 1 by the first sound source 2. At the same time, setting is carried out such that the sub-part is turned off. At this moment, the preceding sound source 2 generates the part off message of Part 2 designated as the sub-part and sends the generated part off message to the following stage. However, since no succeeding sound source is connected to the preceding sound source 2, this control message is not used. Thus, while the specialized sound source data is sent as Part 1 from the automatic playing apparatus 1 and the general-purpose sound source data is concurrently sent as Part 2, the sole sound source 2 captures or admits only the specialized sound source data of Part 1 for vocalization. The vocalization by the general-purpose sound source data of Part 2 is inhibited in the sole sound source 2.

As described above, the automatic playing apparatus 1 is connected to either of the first sound source 2 and the second sound source 3. The above-mentioned operations take place dependently on actual connecting states of the sound sources. The following describes in detail the operations of each sound source with reference to a flowchart indicating MIDI receive processing of a MIDI signal sent from the automatic playing apparatus. It should be noted that, if both of the specialized sound source 2 and the general-purpose sound source 3 are connected to the automatic playing apparatus 1, the specialized sound source 2 has the highest priority followed by the general-purpose sound source 3. Among various general-purpose sound sources, a PCM sound source takes precedence over an FM sound source.

Figure 2:
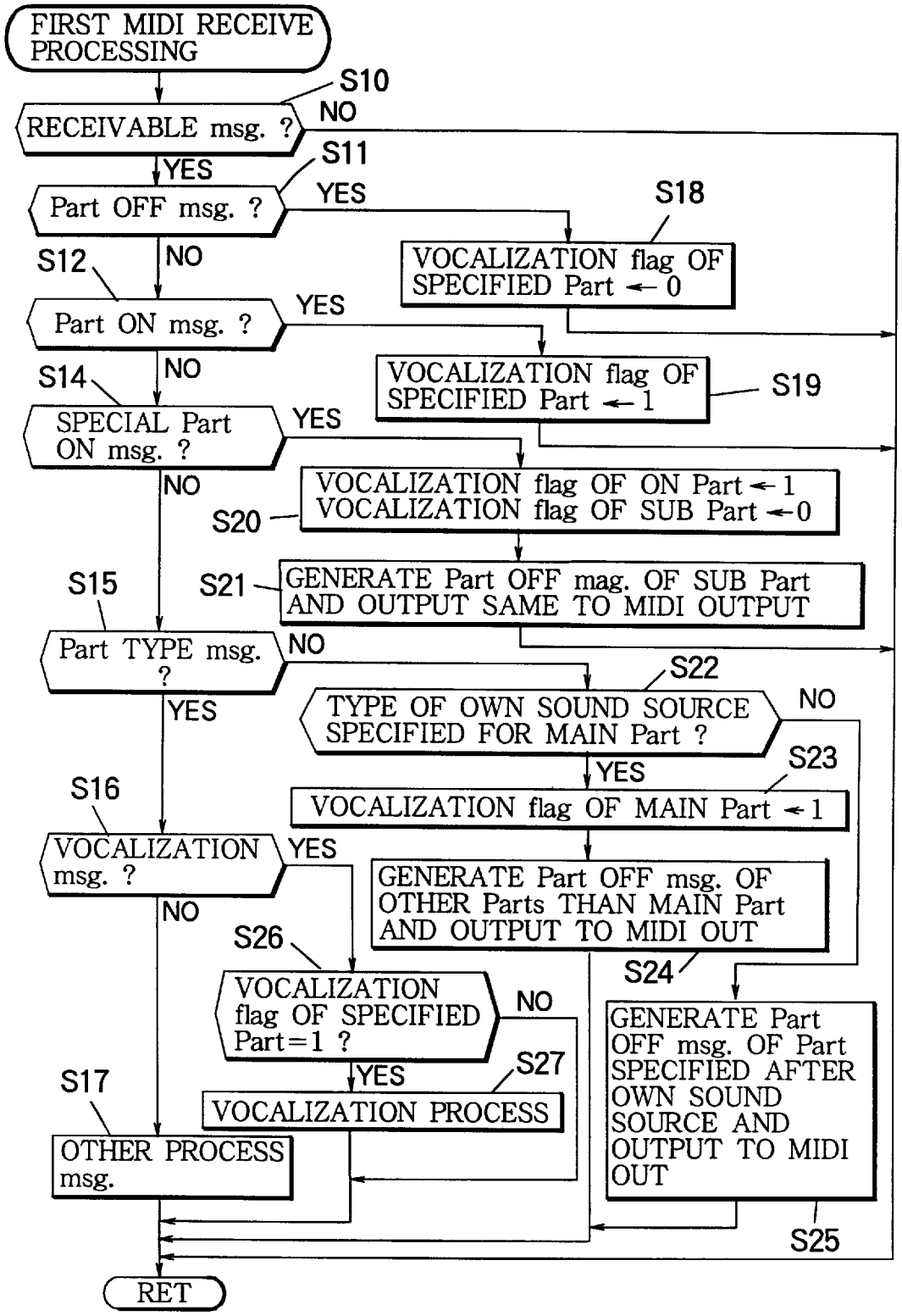
FIG. 2 is a flowchart of first MIDI receive process indicating operation of the musical system according to the present invention.

FIG. 2 shows the flowchart indicating first MIDI receive processing to be executed by the specialized sound source 2 associated with the present invention. The MIDI receive processing is invoked by an interrupt caused by reception of a MIDI signal. To be specific, upon reception of the MIDI signal, the first sound source 2 starts the first MIDI receive processing and determines whether the MIDI signal received in step S10 is a message addressed to the first sound source 2. If the MIDI signal is found a receivable message addressed to the sound source 2, the decision is YES and the process goes to step S11. If not, the decision is NO and the process returns.

In step S11, it is determined whether the received MIDI signal is a part off message. If it is found that the part off message is received, the decision is YES and the process branches to step S18. Then, in step S18, a vocalization flag corresponding to a specified part number (refer to FIG. 4(*a*)) to be turned off included in the part off message is set to "0" to inhibit the vocalization of that part. In the constitution of FIGS. 1(*a*)–1(*c*), Part I that is the part to be vocalized by the first sound source 2 is specified by the specified part number. Therefore, the vocalization flag of Part 1 is set to "0". Then, the process returns to a state being processed before the interrupt has been caused. It should be noted that the part off message of Part 1 is also received by the second sound source 3 to inhibit the vocalization of Part 1 in the second sound source 3.

If the received MIDI signal is not a part off message, the decision is NO in step S11 and the process goes to step S12. In step S12, it is determined whether the received MIDI signal is a part on message. If it is found that the part on message is received, the decision is YES and the process branches to step S19. The part on message (Part ON msg.) includes the number information of the part to be turned on arranged in a format shown in FIG. 4(*b*). In step S19, the vocalization flag of the part specified by the part on message is set to "1" to enable the vocalization of that part. Thereafter, the process returns. It should be noted that, since this part on message is not used in the present invention, it is normally determined NO in step S12 and the process goes to step S14.

In step S14, it is determined whether the received MIDI signal is a special part on message. If it is found that the special part on message is received, the decision is YES and the process branches to step S20. In step S20, the vocalization flag corresponding to the specified part number to be turned on included in the special part on message is set to "1" as shown in FIG. 4(*c*) to enable the vocalization of that part. In this case, Part 1 allocated with the specialized sound source data is specified by the specified part number and the vocalization flag of Part 1 is set to "1". It should be noted that, since the second sound source 3 cannot receive the special part on message, only the first sound source 2 can vocalize Part 1 by the exclusive special part on message. At the same time, the vocalization flag of Part 2 is set to "0" to prohibit vocalization of the sub-part.

Next, in step S21, a part off message for turning off a sub-part of which number information is included in the special part on message is generated, and is output from the MIDI OUT terminal. The sub-part is a proxy or substitute vocalization part that is prepared to perform vocalization by a substitute sound source in place of the sound source 2. In this case, the sub-part is Part 2. The part off message for turning off Part 2 is received in the form of a control message by the succeeding sound source 3. Then, the process returns to the state being processed before the interrupt was caused.

If the received MIDI signal is not a special part on message, the decision is NO in step S14 and the process goes to step S15 where it is determined whether the received MIDI signal is a part type message. If the received MIDI signal is found the part type message in step S15, the process branches to step S22 and the processing of step S22 or S25 is executed, which will be described later.

As shown in FIG. 4(*d*), the part type message (Part TYPE msg.) is composed of message byte number information (Msg. Byte Num) indicating a length of the message, a pair of main part number information (Main Part Num) and corresponding sound source type information (TYPE), and another pair of part number information (Part Num) and corresponding sound source type information (TYPE).

Sound source types include a special sound source such as a VA sound source and a general sound source such as PCM and FM sound sources. The pairs of part numbers and corresponding sound source types are arranged as reference information according to predetermined vocalization priorities of these sound sources. The highest vocalization priority is given to the specialized sound source, which is allotted to the main part. Subsequently, the PCM sound source and then the FM sound source are prioritized in this order.

If the MIDI signal received in step S15 is not the part type message, the decision is NO and the process goes to step S16. In step S16, it is determined whether the MIDI signal received in step S16 is a vocalization message. If the MIDI signal received is found the vocalization message, the decision is YES and the process branches to step S26. In step S26, it is determined whether the vocalization flag of the part corresponding to the received vocalization message is "1". If the received message is the vocalization message of Part 1, since the vocalization flag of Part 1 has been set to "1" in step S20, the decision of step S26 is YES. Then, in step S27, vocalization processing is performed for generating a musical tone. Then, the process returns to the state being processed before the interrupt was caused. If the received message is found the vocalization message of Part 2, sent the vocalization flag of Part 2 has been set to "0" in step S20, the decision is NO and the process returns without performing the vocalization processing. If the received MIDI signal is not the vocalization message, the decision is NO in step S16 and other message processing is performed in step S17 and the process returns. It should be noted that the vocalization flag of the sub-part is set to "0" in step S20 to prevent a general-purpose sound source from being vocalized by the vocalization message of Part 2 when the first receiving device has both of the specialized sound source and the general-purpose sound source.

Thus, by connecting the newly obtained sound source 2 between the existing general-purpose sound source 3 and the automatic playing apparatus 1, the new sound source is allowed to generate high-quality musical sounds while concurrently supplying both the specialized sound source data and the general-purpose sound source data from the automatic playing apparatus 1. According to the invention, the musical system is composed of the transmitting device in the form of the automatic playing apparatus 1 that transmits performance data, the first receiving device that is connectable to the transmitting device to receive and pass the performance data, and the second receiving device that is connectable subsequently to the first receiving device to receive therefrom the performance data. The automatic playing apparatus 1 operates to transmit first performance data arranged to drive the first sound source 2 to generate musical tones and to transmit second performance data arranged to drive the second sound source 3 of a type different than the first sound source 2. The first receiving device operates if the same has the first sound source 2 for admitting the first performance data so as to drive the first sound source 2 and for issuing the control message to the second receiving device. The second receiving device having the second sound source 3 operates in response to the control message to prohibit admission of the second performance data to thereby disable the second sound source 3. In detail, the first receiving device has the first sound source 2 of a superior type driven by the first performance data to generate the musical tones having a relatively high quality, and the second receiving device has the second sound source 3 of an inferior type driven by the second performance data to generate the musical tones having a relatively low quality, so that the automatic playing apparatus 1 can automatically activate the first sound source 2 and inactivate the second sound source 3 when both of the first receiving device and the second receiving device are connected in series to the automatic playing apparatus 1. In this embodiment, the automatic playing apparatus 1 issues the initiative message exclusively addressed to the first receiving device so as to initiate the first receiving device to admit the first performance data and to subsequently issue the control message. The first receiving device has the first sound source 2 of a new type, while the second receiving device has the second sound source 3 of an old type. The automatic playing apparatus 1 transmits both of the first performance data and the second performance data for exclusively driving the first sound source 2 of the new type when the first sound source of new type is introduced in addition to the second sound source 3 of the old type and for driving the second sound source 3 of the old type when said second sound source is directly connected to the automatic playing apparatus 1.

Occasionally, it is assumed that the vocalization of Part 1 has been held off for some reason. In such a case, the user of the musical system wants to turn on the vocalization of Part 1 by use of a part type message. However, as described above, no message can be prepared as the part type message that could turn on exclusively the sound source corresponding to Part 1 as shown in FIG. 4(*d*). Therefore, it is so configured that, if there is a main part, a corresponding sound source is always turned on. Using this configuration, the vocalization of Part 1 is triggered by the part type message by the processing of step S22 through step S24. It should be noted that the main part in this case is Part 1.

To be specific, if the MIDI signal received in step S15 is found the part type message, the process branches to step S22, in which matching with reference information contained in the part type message is performed to determine whether the sound source type specified corresponds to the sound source of the main part. In this case, if the match is held between the sound source type assigned to the main part and the actual sound source type equipped in the first receiving device, the decision is YES and the process goes to step S23. Then, in step S23, the vocalization flag of the main part is set to "1" to activate the first sound source to vocalize the main part. In this case, the specialized sound source corresponds to the sound source type assigned to the main part. The first sound source 2 is enabled or activated for vocalization of the main part that is Part 1.

Further, the subsequent part off message of a specified part other than the main part is generated in step S24, and is output from the MIDI OUT terminal. In the system of FIG. 1(*a*), this part off message is received by the succeedingly connected sound source 3. Then, the process returns to the state being processed before the interrupt was caused.

If it is found that the sound source type of the first receiving device is not specified for the main part in step S22, the decision is NO and the process branches to step S25. In step S25, the subsequent part off message corresponding to the type of a sound source lower in priority than the own sound source type specified in the part type message is generated and outputted from the MIDI OUT terminal. This control message inhibits the vocalization from succeeding sound sources having lower priorities such as a FM sound source succeedingly connected to the sound source. Then, the process returns to the state being processed before the interrupt was caused.

As described above, the inventive musical system is composed of the transmitting device that transmits performance data, the first receiving device that is connectable to the transmitting device to receive and pass the performance data, and the second receiving device that is connectable subsequently to the first receiving device to receive therefrom the performance data. The transmitting device operates to transmit first performance data arranged to drive the first sound source 2 to generate musical tones, further operates to transmit second performance data having a version different than that of the first performance data and being arranged to drive the second sound source 3 of a type different than that of the first sound source 2, and operates to transmit the reference information which indicates correspondence between the type of the sound source and the version of the performance data. The first receiving device operates if said first receiving device has the first sound source for admitting the corresponding first performance data according to the reference information so as to drive the first sound source 2 and for issuing the control message to the second receiving device. The second receiving device having the second sound source 3 operates in response to the control message to prohibit admission of the second performance data to thereby disable the second sound source 3.

In variation, three or more of sound sources may be connected in series to the automatic playing apparatus 1. For example, a VA sound source, a PCM sound source and an FM sound source are sequentially connected to the automatic playing apparatus in this order. In another example, a VA sound source of a higher or superior model, another VA source of a lower or inferior model and a general-purpose sound source are connected to the automatic playing apparatus in this order. In such a case, all of the sound sources except for the last sound source operate to control subsequent sound sources as illustrated in the flowchart of FIG. 2. In detail, the automatic playing apparatus 1 transmits the performance data representing different versions of a melody line of a desired music in the form of Part 1, Part 2 and Part 3, which are respectively assigned to the VA sound source, the PCM sound source and the FM sound source, if these sound sources are sequentially connected to the automatic playing apparatus. In this case, the Part 1 is designated to the main part corresponding to the VA sound source. The first VA sound source operates upon receipt of the part type message (reference information) to execute the processes indicated by steps S22, S23 and S24 of FIG. 2, thereby inhibiting tone generation of the second PCM sound source and the third FM sound source.

The user may connect these different types of the sound sources in a different manner, for example, in the order of the PCM sound source, the FM sound source and the VA sound source. In such a case, the first PCM sound source operates upon receipt of the part type message to execute the processes of steps S22 and S25 so as to inhibit tone generation of the subsequent FM sound source. However, the PCM sound source cannot inhibit tone generation of the subsequent VA sound source. Therefore, the VA sound source generates the musical tones of the main part assigned to the VA sound source. Thus, the melody line is duplicatively played back by both of the PCM sound source and the VA sound source. If the VA sound source is not connected, the PCM sound source can alone play back the melody line. It should be noted that the PCM sound source cannot recognize whether the VA sound source is connected subsequently thereto. Such a duplicate playback of the melody line is prevented if the different types of the sound sources are sequentially connected to the automatic playing apparatus according to the predetermined order of the priority, namely in the order of the VA sound source, the PCM sound source and the FM sound source.

Figure 3:
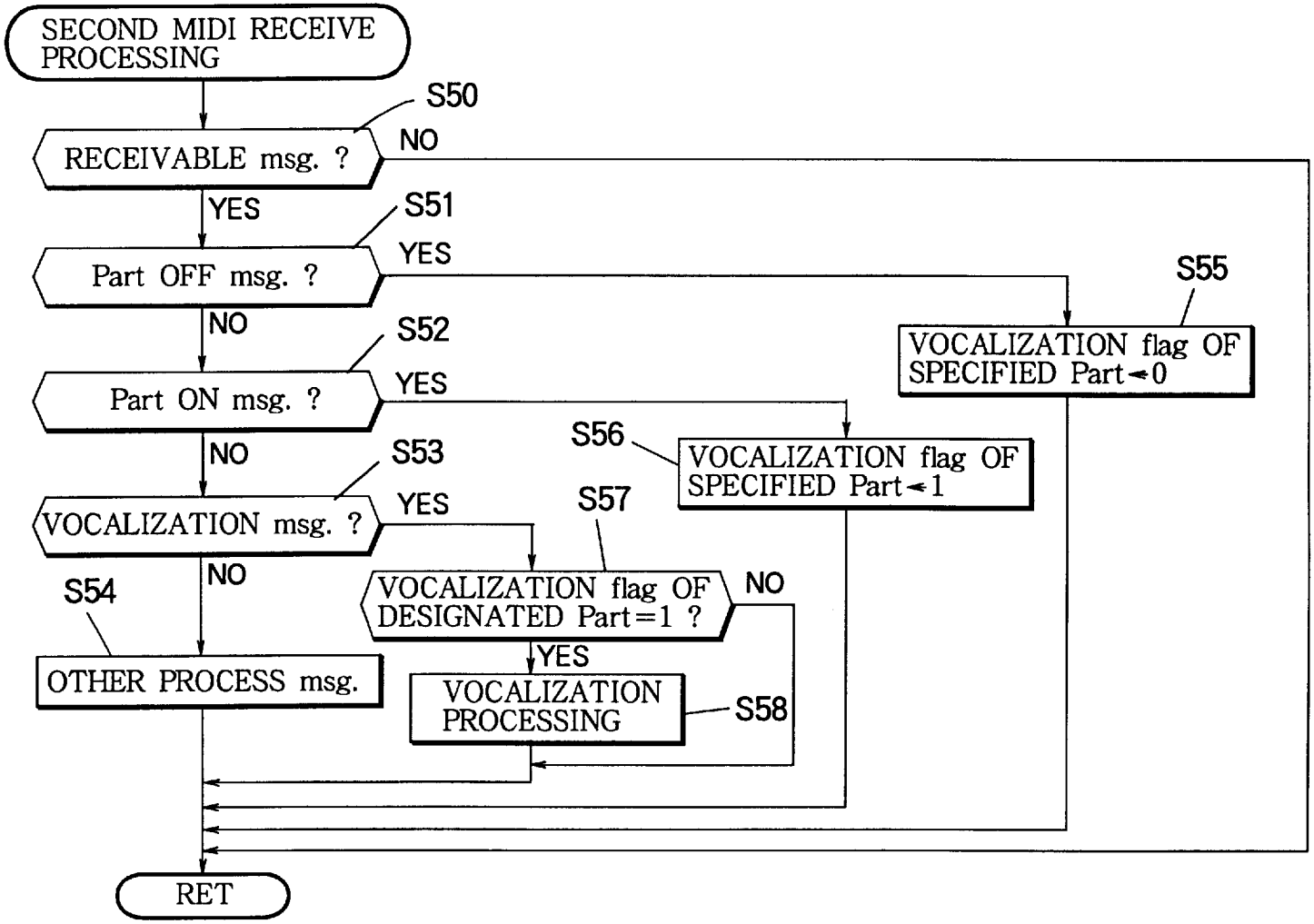
FIG. 3 is a flowchart of second MIDI receive process indicating operation of the inventive musical system.

The following describes a flowchart of FIG. 3 indicating second MIDI receive processing executed by the second sound source 3 upon reception of a MIDI signal. When the second sound source 3 receives a MIDI signal, an interrupt is caused to start the second MIDI receive processing. It is determined whether the MIDI signal received in step S50 is a message addressed to the second sound source. If the MIDI signal is found a receivable message addressed to the second sound source, the decision is YES and the process goes to step S51. In this case, the second sound source 3 is an existing sound source, so that the second sound source cannot process a special part on message and a part type message. Therefore, when these messages are received, it is determined that the received messages are not addressed to the second sound source, whereby the process returns.

In step S51, it is determined whether the received MIDI signal is a part off message. If it is found that the part off message is received, the decision is YES and the process branches to step S55. In step S55, the vocalization flag corresponding to the specified part number (refer to FIG. 4(*a*)) included in the received part off message is set to "0", thereby inhibiting the vocalization of that part. To be specific, the part off message of Part 1 is initially fed from the automatic playing apparatus 1 as described before to set the vocalization flag of Part 1 to "0". Further, by the subsequent part off message of the sub-part (Part 2) fed from the first sound source 2, the vocalization flag of Part 2 is also set to "0". Then, the process returns to the state being processed before the interrupt was caused.

If the received MIDI signal is not the part off message, the decision is NO in step S51 and the process goes to step S52. In step S52, it is determined whether the received MIDI signal is a part on message. If it is found that the part on message is received, the decision is YES and the process branches to step S56. The part on message (Part ON msg.) includes number information about the part to be turned on as shown in FIG. 4(*b*). In step S56, the vocalization flag for the part specified in the part on message is set to "1" to enable vocalization of that part. Thereafter, the process returns. However, because this part on message is not used in the present invention, it is normally determined NO in step S52, whereby the process goes to step S53.

In step S53, it is determined whether the received MIDI signal is a vocalization message. If it is found that the vocalization message is received, the decision is YES and the process branches to step S57. In step S57, it is determined whether the vocalization flag of the part designated by the received vocalization message is "1". At this moment, the vocalization flags of Part 1 and Part 2 are set to "0" in step S55 even if either of the vocalization message of Part 1 and the vocalization message of Part 2 is received, so that the decision is NO and the process returns without executing the vocalization processing.

If the first sound source 2 is not connected preceding to the second sound source 3, the part off message of Part 2 is not fed to the second sound source 3, so that the decision is YES in step S57 and vocalization processing is performed for Part 2 in step S58 so as to generate musical tones of Part 2. It should be noted that, because the part off message of Part 1 is fed from the automatic playing apparatus 1, the vocalization flag of Part 1 remains "0".

Thus, by supplying the specialized sound source data and the general-purpose sound source data from the automatic playing apparatus 1 while connecting the newly introduced sound source 2 between the existing general-purpose sound source 3 and the automatic playing apparatus 1, the new sound source 2 is allowed to vocalize high-quality musical sounds. At the same time, the old sound source 3 is prohibited from vocalization. The automatic playing apparatus 1 sends first and second performance data contained in the first and second sound source data corresponding to the sound sources allocated to Part 1 and Part 2 such that good vocalization can be achieved with any type of a sound source connected. These performance data can be initially supplied to the automatic playing apparatus 1 by means of a recording medium such as a floppy disc.

In modification, the transmitting device may transmit third performance data arranged to drive the second sound source and to accompany either of the first performance data and the second performance data. In such a case, the second receiving device can receive the third performance data from the transmitting device whichever the transmitting device is directly (without the first receiving device) or indirectly (through the first receiving device) connected to the second receiving device so as to drive the second sound source to generate the musical tone according to the third performance data. For example, the first and second performance data represent different versions of a melody part of a desired music while the third performance data represents an accompaniment part such as a chord part or a bass part of the same music composition.

As mentioned above and according to the invention, if the preceding sound source is a specialized sound source, the sound source can capture the specialized sound source data to vocalize it same. At the same time, the succeeding sound source is prevented from capturing the general-purpose sound source data. In addition, based on the reference information sent from the transmitting device concerning the relationship between the versions of the performance data and the types of the above-mentioned sound sources, the preceding sound source can capture a necessary version of the performance data corresponding to the type of the preceding sound source. At the same time, the succeedingly connected sound sources of the lower priorities are prevented from capturing the performance data for blocking vocalization.

Figure 5:
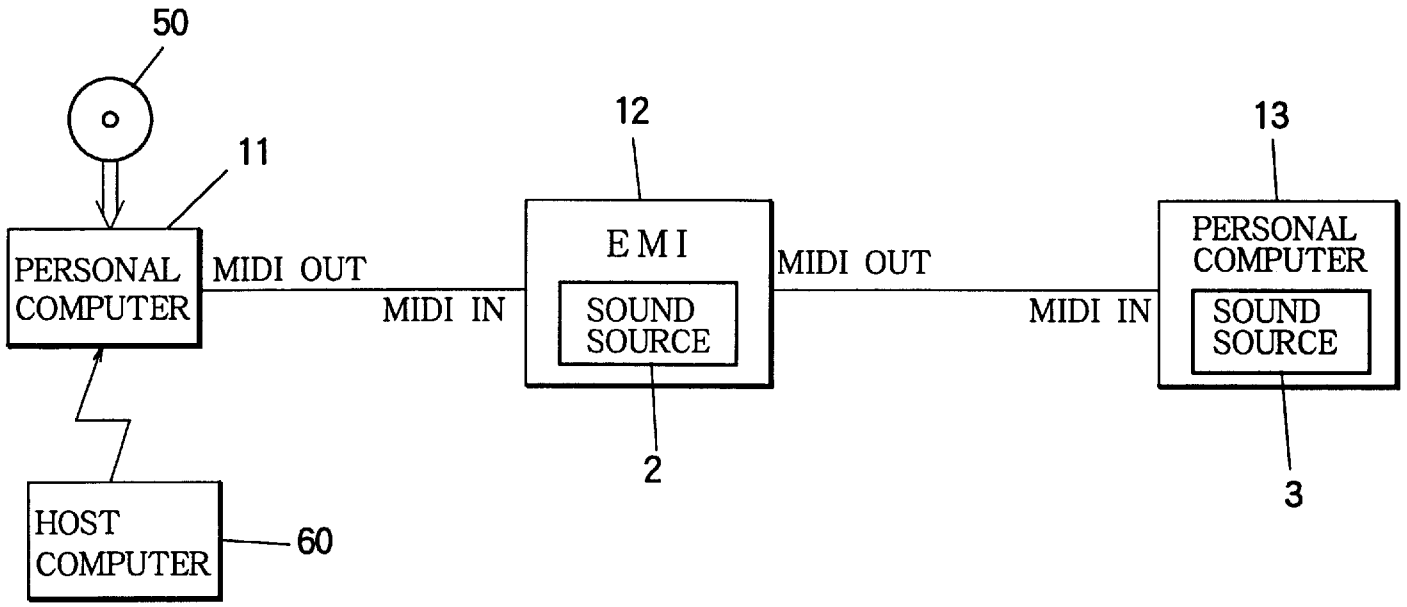
FIG. 5 is a block diagram showing another embodiment of the inventive musical system.

FIG. 5 is a block diagram showing another embodiment of the inventive musical system. The system is composed of a personal computer 11, an electronic musical instrument (EMI) 12 and another personal computer 13. The personal computer 11 works as the transmitting device for transmitting the first performance data, the second performance data, the initiative message and the reference information in the form of MIDI signals in manner similar to the previous embodiment shown in FIG. 1(*a*). Generally, the transmitting device may be selected from various apparatuses such as an automatic playing apparatus, a personal computer, an electronic musical instrument, a sequencer and a karaoke machine. The EMI 12 is connected to the personal computer 11 and works as the first receiving device for receiving the performance data, the initiative message and the reference information and for transmitting the subsequent control message in manner similar to the FIG. 1(*a*) embodiment. The EMI 12 is equipped with the special sound source 2. Generally, the first transmitting device is selected from various apparatuses such as an electronic musical instrument, a sequencer, a personal computer, a karaoke machine and a game machine. The personal computer 13 works as the second receiving device connected subsequently to the EMI 12 for receiving the performance data and the control message. The personal computer 13 is equipped with the general-purpose sound source 3 composed of a software module. Generally, the second receiving device is selected from various apparatuses such as an electronic musical instrument, a sequencer, a personal computer, a karaoke machine and a game machine.

The personal computer 11 operates according to a program to control the musical system. The program is normally installed in an internal memory of the personal computer 11. However, if such a program is not installed in the internal memory, the necessary program can be provided to the user by means of a machine readable media such as a CD-ROM 50 or a floppy disc. The machine readable media contains instructions for causing the personal computer 11 to control the inventive musical system as described in conjunction with the flowcharts of FIGS. 2 and 3. Alternatively, the personal computer may obtain the necessary program from a host computer 60 which is connected to the personal computer 11 through a communication network such as LAN (Local Area Network), public telephone network and INTERNET.

Figure 6:
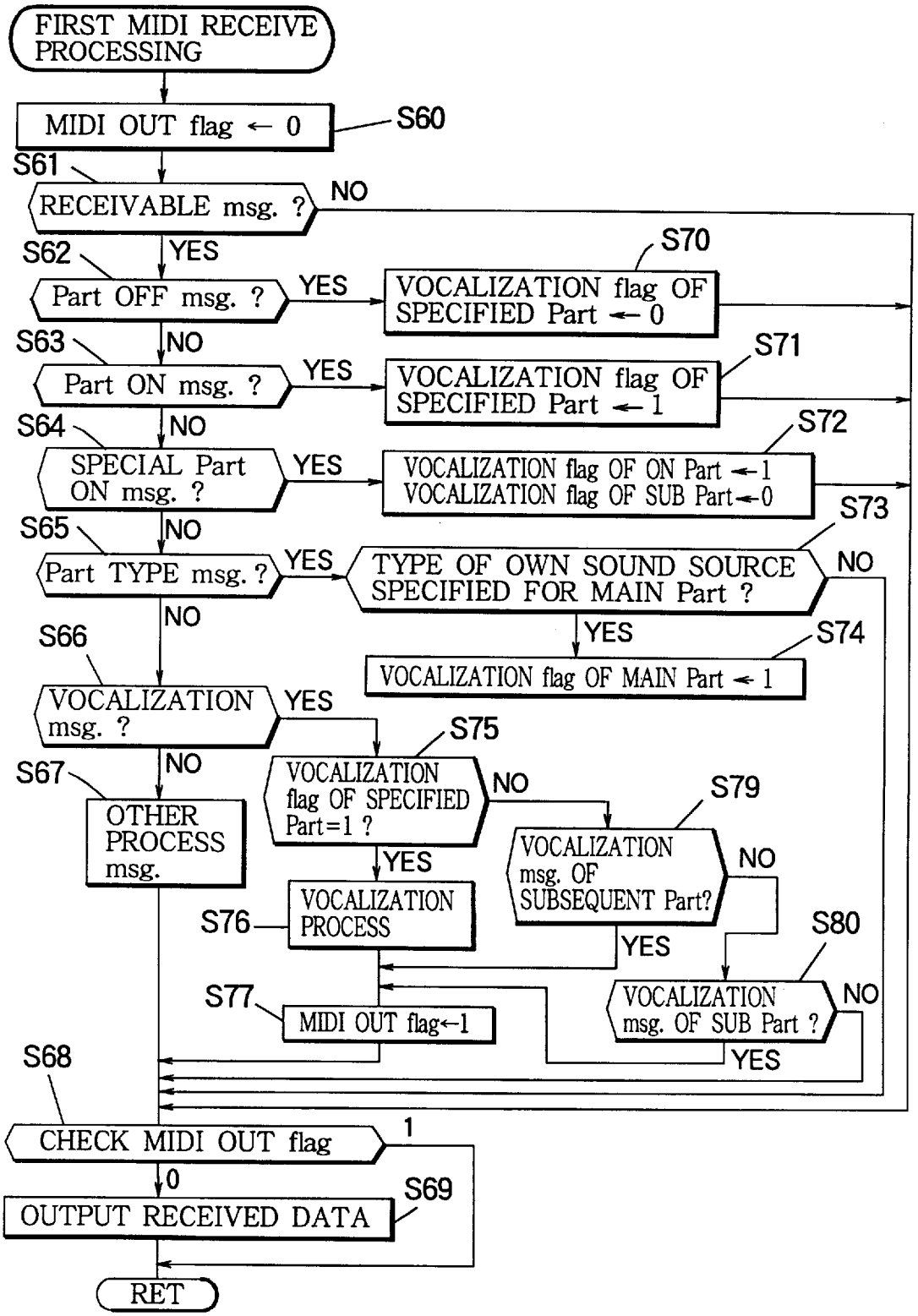
FIG. 6 is a flowchart showing a further embodiment of the inventive musical system.

In the previous embodiment, the first sound source 2 issues a control message effective to prohibit the second sound source 3 from admitting the second performance data to disable or inactivate the second sound source 3. In the following embodiment, the first sound source 2 blocks flow of the second performance data so that the second sound source 3 cannot receive the second performance data. Description is given for this embodiment in conjunction with a flowchart of FIG. 6 which shows MIDI receive processing of the first sound source 2.

First, upon receipt of a MIDI message, step S60 is undertaken to set "0" into a MIDI out flag which is later used at steps S68 and S69 to check as to if the received MIDI message or data should be outputted from a MIDI output module. Then, check is made at step S61 as to if the MIDI message is receivable by the first sound source 2. If NO, the message is directly sent to the MIDI output module without internal processing. If the check result of step S61 is YES, the routine advances to step S62 where the check is made as to if the received message is a part off message. If YES, a vocalization flag of a part designated by the part off message is set to "0" at step S70 so that the first sound source 2 does not play back the designated part even if corresponding performance data is inputted to the first sound source 2.

Then, check is made at subsequent step S63 as to if the received message is a part on message. If YES, a vocalization flag of a part designated by the part on message is set to "1" at step S71 so that the first sound source 2 is allowed to play back the designated part when corresponding performance data is inputted to the first sound source 2.

If the check result of step S63 is NO, subsequent check is made at step S64 as to if the received message is a special part on message, which is specifically addressed to a specialized sound source such as the first sound source 2. Other types of the sound sources do not respond to the special part on message. If the check result of step S64 is YES, a vocalization flag of the special part is set to "1" at step S72 so as to activate the special part. Further, a vocalization flag of a subpart is set to "0". The subpart is prepared in place of the special part to generate tones if the first sound source does not correspond to the special part. In this case, the first sound source corresponds to the special part so that the vocalization flag of the subpart is set with "0" to avoid duplicative tone generation. As described later, the performance data of the subpart is not outputted from the first sound source 2 since the corresponding MIDI out flag is set to "1" at steps S80 and S77 so that subsequent sound sources do not play back the subpart. Further, the performance data of the special part is not outputted from the first sound source 2 since the corresponding MIDI out flag is set to "1" at step S77 so that subsequent sound sources do not play back the special part.

If the check result of step S64 is NO, subsequent check is made at step S65 as to if the received message is a part type message. This part type message designates a type of the sound source (VA, PCM and FM) corresponding to the main part. The part type message may be contained in a timbre designation message such as a program change message. If the check result of step S65 is YES, subsequent check is made at step S73 as to if the own type of the first sound source is designated by the part type message. If YES, the vocalization flag of the main part is set to "1" at step S74 so as to prepare for vocalization of the main part when the corresponding event data is supplied. If the first sound source is the PCM type and the subsequent or second sound source is the FM type, when the first sound source receives performance data assigned to the FM sound source, the MIDI out flag of the received performance data is set to "1" at steps S77 and S79 to block outputting of the received performance data. By this, the subsequent FM sound source is inhibited from the tone generation.

If the check result of step S65 is NO, subsequent check is made at step S66 as to if the received message is a vocalization message containing performance data. If YES, the routine branches to steps S75–S80 as described above. Further, the routine returns through steps S68 and S69. In these steps, the first sound source blocks flow of the first performance data since the same is vocalized by itself and also blocks flow of the second performance data since the same is a spare of the first performance data, thereby avoiding duplicative tone generation by the subsequent sound source.

What is claimed is:

1. A musical system comprising a transmitting device that transmits performance data, a first receiving device that is connected to the transmitting device to receive the performance data, and a second receiving device that is connected to one of the first receiving device to receive therefrom the performance data, and the transmitting device to receive directly therefrom the performance data, wherein the performance data comprises first performance data arranged to drive a first sound source to generate musical tones and second performance data arranged to drive a second sound source of a type different than the first sound source, wherein:

with the second receiving device connected to the first receiving device, the first receiving device having the first sound source admits the first performance data so as to drive the first sound source and controls the second receiving device having the second sound source to disable the second sound source, and with the second receiving device connected directly to the transmitting device, the second receiving device operates to admit the second performance data so as to drive the second sound source.

2. A musical system according to claim 1, wherein with the first receiving device connected to the second receiving device, the first receiving device blocks the second performance data so that the second receiving device is unable to admit the second performance data so as to disable the second sound source.

3. A musical system according to claim 1, wherein the transmitting device initially transmits a first control message effective to inhibit admission of the first performance data, and further transmits a second control message specifically addressed to the first receiving device to exclusively allow the first receiving device to admit the first performance data while the second receiving device remains inhibited from admission of the first performance data according to the first control message, and wherein the first receiving device operates in response to the second control message to inhibit the subsequent second receiving device from admission of the second performance data so as to disable the second sound source.

4. A musical system according to claim 3, wherein the first receiving device operates in response to the second control message for issuing a third control message effective to control the subsequent second receiving device to inhibit admission of the second performance data.

5. A musical system according to claim 1, wherein the transmitting device further transmits third performance data arranged to drive the second sound source and to accompany either of the first performance data and the second performance data, and wherein the second receiving device can receive the third performance data from the transmitting device with the transmitting device connected to one of the first receiving device and the second receiving device so as to drive the second sound source to generate the musical tone according to the third performance data.

6. A musical system comprising a transmitting device that transmits performance data, a first receiving device that is connected to the transmitting device to receive the performance data, and a second receiving device that is connected to one of the first receiving device to receive therefrom the performance data, and the transmitting device to receive directly therefrom the performance data, wherein the performance data comprises first performance data arranged to drive a first sound source to generate musical tones and second performance data having a version different than that of the first performance data and being arranged to drive a second sound source of a type different than that of the first sound source, and the transmitting device transmits reference information which indicates correspondence between the type of the sound source and the version of the performance data, the first receiving device operates if the first receiving device has the first sound source to admit the corresponding first performance data according to the reference information so as to drive the first sound source and with the first receiving device connected to the second receiving device, to control the second receiving device having the second sound source so as to disable the second sound source, and with the second receiving device connected directly to the transmitting device, the second receiving device operates to admit the second performance data so as to drive the second sound source.

7. A musical system according to claim 6, wherein with the first receiving device connected to the second receiving device, the first receiving device blocks transfer of the second performance data according to the reference information so that the second receiving device is unable to admit the second performance data thereby disabling the second sound source.

8. A musical system according to claim 6, wherein with the first receiving device connected to the second receiving device, the first receiving device issues a control message according to the reference information, effective to control the subsequent second receiving device to inhibit admission of the second performance data so as to disable the second sound source.

9. A musical system according to claim 6, wherein when the first receiving device does not have the first sound source, the first receiving device admits substitute performance data to drive a sound source contained in the first receiving device according to the reference information, and for inactivating a subsequent receiving device over which the first receiving device has a priority in generation of musical tones.

10. A method of operating a musical system composed of a transmitting device that transmits performance data, a first receiving device that is connected to the transmitting device to receive the performance data, and a second receiving device that is connected to one of the first receiving device to receive therefrom the performance data, and the transmitting device to receive directly therefrom the performance data, the method comprising the steps of:

operating the transmitting device to transmit first performance data arranged to drive a first sound source to generate musical tones and to transmit second performance data arranged to drive a second sound source of a type different than the first sound source;

with the first receiving device connected to the second receiving device, operating the first receiving device having the first sound source for admitting the first performance data so as to drive the first sound source and for controlling the second receiving device having the second sound source to disable the second sound source; and with the second receiving device connected directly to the transmitting device, operating the second receiving device to admit the second performance data so as to drive the second sound source.

11. A method of operating a musical system according to claim 10, wherein with the first receiving device connected to the second receiving device, the step of operating the first receiving device comprises operating the first receiving device to block the second performance data so that the second receiving device is unable to admit the second performance data thereby disabling the second sound source.

12. A method of operating a musical system according to claim 10, wherein the step of operating the transmitting device comprises initially transmitting a first control message effective to inhibit admission of the first performance data, and further transmitting a second control message specifically addressed to the first receiving device to exclusively allow the first receiving device to admit the first performance data while the second receiving device remains inhibited from admission of the first performance data according to the first control message, and wherein the step of operating the first receiving device comprises operating the first receiving device in response to the second control message to inhibit the subsequent second receiving device from admission of the second performance data so as to disable the second sound source.

13. A machine-readable media containing instructions for conducting a method of operating a musical system composed of a transmitting device that transmits performance data, a first receiving device that is connected to the transmitting device to receive the performance data, and a second receiving device that is connected to one of the first receiving device to receive therefrom the performance data, and the transmitting device to receive directly therefrom the performance data, wherein the method comprises the steps of:

operating the transmitting device to transmit first performance data arranged to drive a first sound source to generate musical tones and to transmit second performance data arranged to drive a second sound source of a type different than the first sound source;

with the first receiving device connected to the second receiving device, operating the first receiving device having the first sound source for admitting the first performance data so as to drive the first sound source and for controlling the second receiving device having the second sound source to disable the second sound source; and with the second receiving device connected directly to the transmitting device, operating the second receiving device to admit the second performance data so as to drive the second sound source.

14. The machine-readable media according to claim 13, wherein with the first receiving device connected to the second receiving device, the step of operating the first receiving device comprises operating the first receiving device to block the second performance data so that the second receiving device is unable to admit the second performance data thereby disabling the second sound source.

15. The machine-readable media according to claim 13, wherein the step of operating the transmitting device comprises initially transmitting a first control message effective to inhibit admission of the first performance data, and further transmitting a second control message specifically addressed to the first receiving device to exclusively allow the first receiving device to admit the first performance data while the second receiving device remains inhibited from admission of the first performance data according to the first control message, and wherein the step of operating the first receiving device comprises operating the first receiving device in response to the second control message to inhibit the subsequent second receiving device from admission of the second performance data so as to disable the second sound source.

16. A musical system comprising a transmitting device that transmits performance data, a first receiving device that is connected to the transmitting device to receive and pass the performance data, and a second receiving device that is connected to one of the first receiving device in series to receive therefrom the performance data, and the transmitting device to receive directly therefrom the performance data, wherein the performance data comprises first performance data arranged to drive a first sound source to generate musical tones and second performance data arranged to drive a second sound source of a type different than the first sound source, the first receiving device operates if the first receiving device contains the first sound source for admitting the first performance data so as to drive the first sound source and for issuing a control message to the second receiving device, and the second receiving device having the second sound source operates in response to the control message to prohibit admission of the second performance data to thereby disable the second sound source.

17. A musical system according to claim 16, wherein the first receiving device has the first sound source with a first priority driven by the first performance data to generate the musical tones having a certain quality, and the second receiving device has the second sound source of a type different than the first sound source and having second priority driven by the second performance data to generate the musical tones having a relatively lower quality than musical tones generated by the first sound source, so that the transmitting device can automatically activate the first sound source and inactivate the second sound source when both of the first receiving device and the second receiving device are connected in series to the transmitting device.

18. A musical system according to claim 16, wherein the transmitting device issues an initiative message exclusively addressed to the first receiving device so as to initiate the first receiving device to admit the first performance data and to subsequently issue the control message.

19. A musical system according to claim 16, wherein the transmitting device delivers reference information which indicates correspondence between the first sound source and the first performance data and between the second sound source and the second performance data so that the first receiving device can exclusively admit the first performance data according to the reference information if the first sound source is included in the first receiving device.

20. A musical system according to claim 16, wherein the first receiving device has the first sound source of a new type, the second receiving device has the second sound source of an old type, and the transmitting device transmits both of the first performance data and the second performance data for exclusively driving the first sound source of the new type when the first sound source of the new type is introduced in addition to the second sound source of the old type and for driving the second sound source of the old type when the second sound source of the old type is directly connected to the transmitting device.

21. A musical system comprising a transmitting device that transmits performance data, a first receiving device that is connected to the transmitting device to receive and pass the performance data, and a second receiving device that is connected to one of the first receiving device to receive therefrom the performance data, and the transmitting device to receive directly therefrom the performance data, wherein the performance data comprises first performance data arranged to drive a first sound source to generate musical tones and second performance data having a version different than that of the first performance data and being arranged to drive a second sound source of a type different than that of the first sound source, and the transmitting device transmits reference information which indicates correspondence between the type of the sound source and the version of the performance data, the first receiving device operates if the first receiving device includes the first sound source for admitting the corresponding first performance data according to the reference information so as to drive the first sound source and for issuing a control message to the second receiving device, and the second receiving device having the second sound source operates in response to the control message to prohibit admission of the second performance data thereby disabling the second sound source.

22. A musical system comprising transmitting means for transmitting performance data, first receiving means connected to the transmitting means to receive and pass the performance data, and second receiving means connected to one of the first receiving means to receive therefrom the performance data, and the transmitting device to receive directly therefrom the performance data, wherein the transmitting means operates to transmit first performance data arranged to drive a first sound source to generate musical tones and to transmit second performance data arranged to drive a second sound source of a type different than the first sound source, the first receiving means operates if the first receiving means includes the first sound source for admitting the first performance data so as to drive the first sound source and for issuing a control message to the second receiving means, and the second receiving means having the second sound source operates in response to the control message to prohibit admission of the second performance data to thereby disable the second sound source.

23. A musical system comprising transmitting means for transmitting performance data, first receiving means connected to the transmitting means to receive and pass the performance data, and second receiving means connected to one of the first receiving means to receive therefrom the performance data, and the transmitting device to receive directly therefrom the performance data, wherein the transmitting means operates to transmit first performance data arranged to drive a first sound source to generate musical tones, further operates to transmit second performance data having a version different than that of the first performance data and being arranged to drive a second sound source of a type different that that of the first sound source, and operates to transmit reference information which indicates correspondence between the type of the sound source and the version of the performance data, the first receiving means operates if the first receiving means contains the first sound source for admitting the corresponding first performance data according to the reference information so as to drive the first sound source and for issuing a control message to the second receiving means, and the second receiving means having the second sound source operates in response to the control message to prohibit admission of the second performance data thereby disabling the second sound source.

24. A method of operating a musical system composed of a transmitting device that transmits performance data, a first receiving device that is connected to the transmitting device to receive and pass the performance data, and a second receiving device that is connected to one of the first receiving device to receive therefrom the performance data, and the transmitting device to receive directly therefrom the performance data, the method comprising the steps of:

operating the transmitting device to transmit first performance data arranged to drive a first sound source to generate musical tones and to transmit second performance data arranged to drive a second source of a type different than the first sound source;

operating the first receiving device if the same has the first sound source for admitting the first performance data so as to drive the first sound source and for issuing a control message to the second receiving device; and operating the second receiving device having the second sound source in response to the control message to prohibit admission of the second performance data to thereby disable the second sound source.

25. A method of operating a musical system composed of a transmitting device that transmits performance data, a first receiving device that is connected to the transmitting device to receive and pass the performance data, and a second receiving device that is connected to one of the first receiving device to receive therefrom the performance data, and the transmitting device to receive directly therefrom the performance data, the method comprising the steps of:

operating the transmitting device to transmit first performance data arranged to drive a first sound source to generate musical tones, further operating the transmitting device to transmit second performance data having a version different than that of the first performance data and being arranged to drive a second sound source of a type different than that of the first sound source, and operating the transmitting device to transmit reference information which indicates correspondence between the type of the sound source and the version of the performance data;

operating the first receiving device if the first receiving device has the first sound source for admitting the first corresponding first performance data according to the reference information so as to drive the first sound source and for issuing a control message to the second receiving device; and operating the second receiving device having the second sound source in response to the control message to prohibit admission of the second performance data to thereby disable the second sound source.

26. A machine-readable media containing instructions for conducting a method of operating a musical system composed of a transmitting device that transmits performance data, a first receiving device that is connected to the transmitting device to receive and pass the performance data, and a second receiving device that is connected to one of the first receiving device to receive therefrom the performance data, and the transmitting device to receive directly therefrom the performance data, wherein the method comprises the steps of:

operating the transmitting device to transmit first performance data arranged to drive a first sound source to generate musical tones and to transmit second performance data arranged to drive a second sound source of a type different than the first sound source;

operating the first receiving device if the first receiving device has the first sound source for admitting the first performance data so as to drive the first sound source and for issuing a control message to the second receiving device; and operating the second receiving device having the second sound source in response to the control message to prohibit admission of the second performance data to thereby disable the second sound source.

27. A machine-readable media containing instructions for conducting a method of operating a musical system composed of a transmitting device that transmits performance data, a first receiving device that is connected to the transmitting device to receive and pass the performance data, and a second receiving device that is connected to one of the first receiving device to receive therefrom the performance data, and the transmitting device to receive directly therefrom the performance data, wherein the method comprises the steps of:

operating the transmitting device to transmit first performance data arranged to drive a first sound source to generate musical tones, further operating the transmitting device to transmit second performance data having a version different than that of the first performance data and being arranged to drive a second sound source of a type different than that of the first sound source, and operating the transmitting device to transmit reference information which indicates correspondence between the type of the sound source and the version of the performance data;

operating the first receiving device if the first receiving device has the first sound source for admitting the corresponding first performance data according to the reference information so as to drive the first sound source and for issuing a control message to the second receiving device; and operating the second receiving device having the second sound source in response to the control message to prohibit admission of the second performance data to thereby disable the second sound source.

* * * * *